US011398697B2

(12) United States Patent
Komoto

(10) Patent No.: US 11,398,697 B2
(45) Date of Patent: Jul. 26, 2022

(54) CONNECTOR AND CONNECTOR MANUFACTURING METHOD

(71) Applicant: Japan Aviation Electronics Industry, Limited, Tokyo (JP)

(72) Inventor: Tetsuya Komoto, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/929,769

(22) Filed: Jul. 15, 2020

(65) Prior Publication Data

US 2021/0075141 A1 Mar. 11, 2021

(30) Foreign Application Priority Data

Sep. 6, 2019 (JP) ..... JP2019-163110

(51) Int. Cl.
*H01R 12/00* (2006.01)
*H01R 13/41* (2006.01)
(Continued)

(52) U.S. Cl.
CPC ..... *H01R 13/41* (2013.01); *H01R 12/716* (2013.01); *H01R 43/20* (2013.01)

(58) Field of Classification Search
CPC ..... H01R 13/41; H01R 12/716; H01R 43/20; H01R 12/57; H01R 13/115; H01R 43/205; H01R 13/42
(Continued)

(56) References Cited

U.S. PATENT DOCUMENTS 5,975,916 A * 11/1999 Okura ..... H01R 12/716 439/74
6,050,829 A * 4/2000 Eldridge ..... G01R 1/07378 324/754.07
(Continued)

FOREIGN PATENT DOCUMENTS

CN 101304149 A 11/2008
CN 106921056 A 7/2017
JP 2017084736 A 5/2017

OTHER PUBLICATIONS

Office Action dated Oct. 27, 2021 in CN Application No. 202010659779.3 is attached, 9 pages.

*Primary Examiner* — Abdullah A Riyami
*Assistant Examiner* — Nelson R. Burgos-Guntin
(74) *Attorney, Agent, or Firm* — Muncy, Geissler, Olds & Lowe, P.C.

(57) ABSTRACT

A connector includes a housing and contacts retained by the housing, the contacts forming contact arrays that linearly extend in a predetermined array direction in parallel to each other, each of the contacts having a mounting portion that is fixed to the mounting object when the connector is mounted on the mounting object and a contact portion that contacts a corresponding contact of the counter connector when the connector is connected to the counter connector, the mounting portions of contacts constituting at least two contact arrays adjacent to each other of the contact arrays extending in a same elongation direction, contacts constituting each contact array of the at least two contact arrays being disposed in a position other than a position where those contacts completely coincide with contacts constituting another contact array of the at least two contact arrays in a direction perpendicular to the predetermined array direction.

13 Claims, 11 Drawing Sheets

(51) Int. Cl.
*H01R 12/71* (2011.01)
*H01R 43/20* (2006.01)

(58) Field of Classification Search
USPC ..... 439/676
See application file for complete search history.

(56) References Cited

U.S. PATENT DOCUMENTS 6,827,588 B1 * 12/2004 Huang ..... H01R 12/716 439/74
7,118,388 B2 * 10/2006 Midorikawa ..... H01R 13/631 439/74
7,195,494 B2 * 3/2007 Ookura ..... H01R 12/57 439/74
7,195,495 B2 * 3/2007 Takano ..... H01R 12/716 439/74
7,247,029 B2 * 7/2007 Chen ..... H01R 12/716 439/66
7,354,279 B2 * 4/2008 Uesaka ..... H01R 12/57 439/660
7,950,933 B1 * 5/2011 Harlan ..... H01R 12/714 439/91
8,858,239 B2 * 10/2014 Little ..... H01R 24/84 439/74
10,862,234 B2 * 12/2020 Horino ..... H01R 13/6473
2005/0009379 A1 * 1/2005 Huang ..... H01R 12/716 439/65
2008/0261462 A1 10/2008 Mizumura
2011/0014800 A1 * 1/2011 Cheng ..... H01R 12/716 439/55
2012/0270446 A1 * 10/2012 Shibata ..... H01R 12/716 439/629
2017/0125930 A1 5/2017 Komoto et al.
2018/0183170 A1 6/2018 Matsuno
2018/0358770 A1 * 12/2018 Light ..... H01R 12/7082
2021/0075141 A1 * 3/2021 Komoto ..... H01R 43/20

* cited by examiner

CONNECTOR AND CONNECTOR MANUFACTURING METHOD

BACKGROUND OF THE INVENTION

The present invention relates to a connector, particularly to a connector mounted on a mounting object and connected to a counter connector.

The present invention also relates to a method of manufacturing such a connector.

As a connector having a large number of contacts, for example, JP 2017-84736 A discloses a receptacle connector 1 and a plug connector 2 both of which have a substantially flat plate shape, as shown in FIG. 27.

The receptacle connector 1 has a plurality of receptacle contacts 4 press-fitted in and retained by a receptacle housing 3 of flat plate shape, and the plug connector 2 has a plurality of plug contacts 6 press-fitted in and retained by a plug housing 5 of flat plate shape. The receptacle contacts 4 form four contact arrays 7 linearly extending in parallel to each other, and the plug contacts 6 form four contact arrays 8 linearly extending in parallel to each other so as to correspond to the four contact arrays 7 of the receptacle connector 1.

When the plug connector 2 is fitted to the receptacle connector 1, as shown in FIG. 28, the plug contacts 6 forming the four contact arrays 8 are connected to the receptacle contacts 4 forming the four contact arrays 7 correspondingly, thus making a connector assembly. FIG. 28 is a cross-sectional view cut along a plane orthogonal to the direction in which the contact arrays 7 and 8 extend.

In manufacture of the receptacle connector 1, since each contact array 7 has plural receptacle contacts 4, receptacle contacts 4 constituting one contact array 7 can be press-fitted together into the receptacle housing 3 while being joined to a single carrier, and then, the carrier can be separated from the receptacle contacts 4 at a time by means of a carrier cutting tool. Thus, a step involving collective press-fitting of plural receptacle contacts 4 joined to a carrier and collective separation thereof is repeated four times to manufacture the receptacle connector 1 having the four contact arrays 7.

Also for the plug connector 2, on the basis of each contact array 8, collective press-fitting of plural plug contacts 6 joined to a carrier and collective separation thereof are serially carried out, thus manufacturing the plug connector 2 having the four contact arrays 8 in the same manner as that for the receptacle connector 1.

As shown in FIG. 28, however, in the receptacle connector 1 of JP 2017-84736 A, the receptacle contacts 4 constituting the four contact arrays 7 are disposed to coincide each other in the direction perpendicular to the contact arrays 7; similarly, in the plug connector 2, the plug contacts 6 constituting the four contact arrays 8 are disposed to coincide each other in the direction perpendicular to the contact arrays 8.

Therefore, in manufacture of the receptacle connector 1, it is difficult to join plural receptacle contacts 4 of plural contact arrays 7, e.g., two contact arrays 7 adjacent to each other to a single carrier, and accordingly, press-fitting and separation of the plural receptacle contacts 4 need to be carried out using separate carriers for the respective contact arrays 7. Similarly, also in manufacture of the plug connector 2, it is difficult to join plural plug contacts 6 of plural contact arrays 8 to a single carrier, and accordingly, press-fitting and separation of the plural plug contacts 6 need to be carried out using separate carriers for the respective contact arrays 8.

Thus, many steps are required to manufacture the receptacle connector 1 and the plug connector 2, disadvantageously.

SUMMARY OF THE INVENTION

The present invention has been made to solve the conventional problem described above and is aimed at providing a connector that allows facilitation of its manufacturing process despite that the connector has a large number of contacts.

The present invention is also aimed at providing a method of manufacturing such a connector.

A connector according to the present invention is a connector mounted on a mounting object and connected to a counter connector, the connector comprising:

a housing; and a plurality of contacts retained by the housing, wherein the plurality of contacts form a plurality of contact arrays that linearly extend in a predetermined array direction in parallel to each other, wherein each of the plurality of contacts has a mounting portion that is fixed to the mounting object when the connector is mounted on the mounting object and a contact portion that contacts a corresponding contact of the counter connector when the connector is connected to the counter connector, wherein the mounting portions of contacts constituting at least two contact arrays adjacent to each other of the plurality of contact arrays extend in a same elongation direction, and wherein contacts constituting each contact array of the at least two contact arrays are disposed in a position other than a position where those contacts completely coincide with contacts constituting another contact array of the at least two contact arrays in a direction perpendicular to the predetermined array direction.

A method of manufacturing a connector according to the present invention comprises:

a step of retaining a plurality of contacts joined to a carrier via corresponding joint portions by a housing; and a step of separating the carrier from the plurality of contacts retained by the housing, wherein the plurality of contacts form a plurality of contact arrays that linearly extend in a predetermined array direction in parallel to each other, wherein the joint portions joined to contacts constituting at least two contact arrays adjacent to each other of the plurality of contact arrays extend in a same elongation direction, and wherein contacts constituting each contact array of the at least two contact arrays are disposed in a position other than a position where those contacts completely coincide with contacts constituting another contact array of the at least two contact arrays in a direction perpendicular to the predetermined array direction.

DETAILED DESCRIPTION OF THE INVENTION

An embodiment of the present invention is described below with reference to the accompanying drawings.

Figure 1:
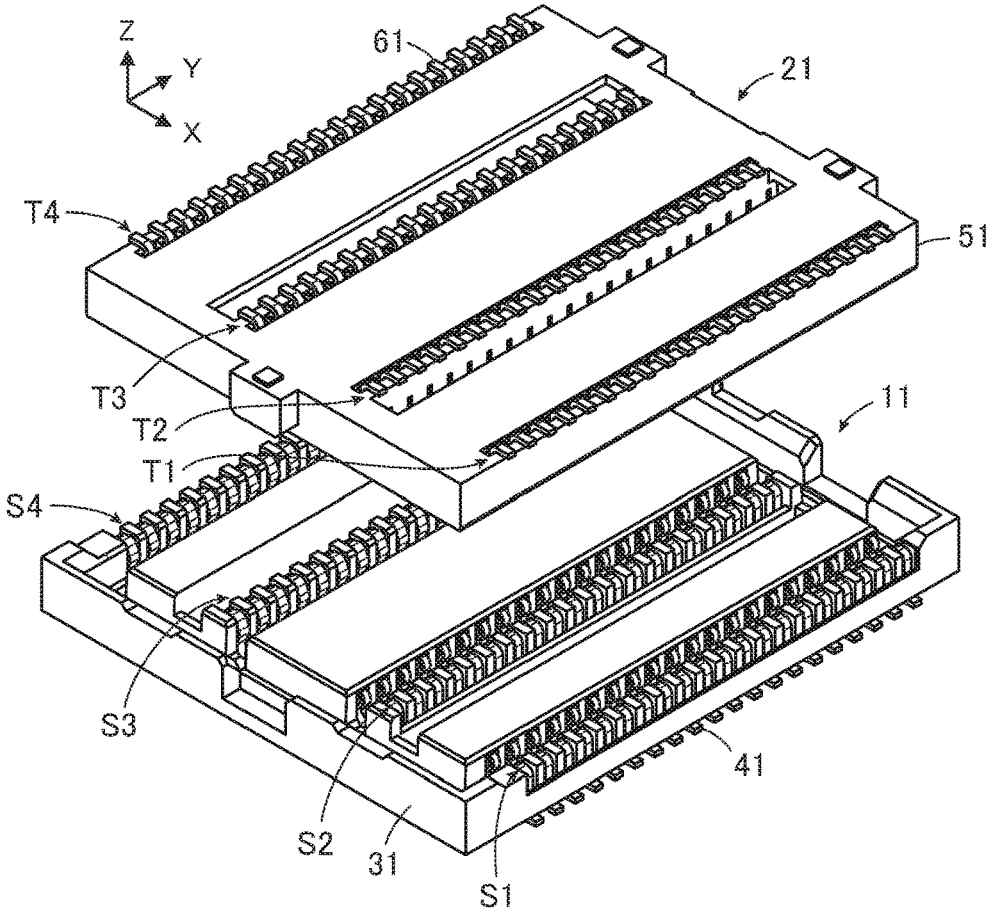
FIG. 1 is a perspective view showing a connector assembly composed of a receptacle connector and a plug connector according to an embodiment of the invention, before fitting.

FIG. 1 shows a receptacle connector (connector) 11 and a plug connector (connector) 21 according to the embodiment before the connectors 11 and 21 are fitted to each other. The receptacle connector 11 and the plug connector 21 constitute a connector assembly, each have a substantially rectangular flat plate shape, and are arranged in parallel to each other.

The receptacle connector 11 has a receptacle housing (housing) 31 and a plurality of receptacle contacts (contacts) 41 retained by the receptacle housing 31. The receptacle contacts 41 form four contact arrays S1 to S4 linearly extending in a predetermined array direction in parallel to each other. Similarly, the plug connector 21 has a plug housing (housing) 51 and a plurality of plug contacts (contacts) 61 retained by the plug housing 51. The plug contacts 61 form four contact arrays T1 to T4 linearly extending in the same array direction as that of the contact arrays S1 to S4 of the receptacle connector 11 in parallel to each other.

The contact arrays S1 to S4 of the receptacle connector 11 and the contact arrays T1 to T4 of the plug connector 21 extend in the same direction.

In the state where the receptacle connector 11 and the plug connector 21 are fitted with each other, the receptacle contacts 41 in the contact arrays S1 to S4 of the receptacle connector 11 are correspondingly connected to the plug contacts 61 in the contact arrays T1 to T4 of the plug connector 21.

For convenience, the plane in which the receptacle connector 11 of substantially flat plate shape extends is called "XY plane," the predetermined array direction in which the contact arrays S1 to S4 of the receptacle connector 11 extend "Y direction," the direction in which the contact arrays S1 to S4 are arranged "X direction," and the direction perpendicular to an XY plane and from the receptacle connector 11 toward the plug connector 21 "+Z direction."

As with the receptacle connector 11, the plug connector 21 extends along an XY plane, the contact arrays T1 to T4 of the plug connector 21 extend in the Y direction, and the contact arrays T1 to T4 are arranged in the X direction.

Figure 2:
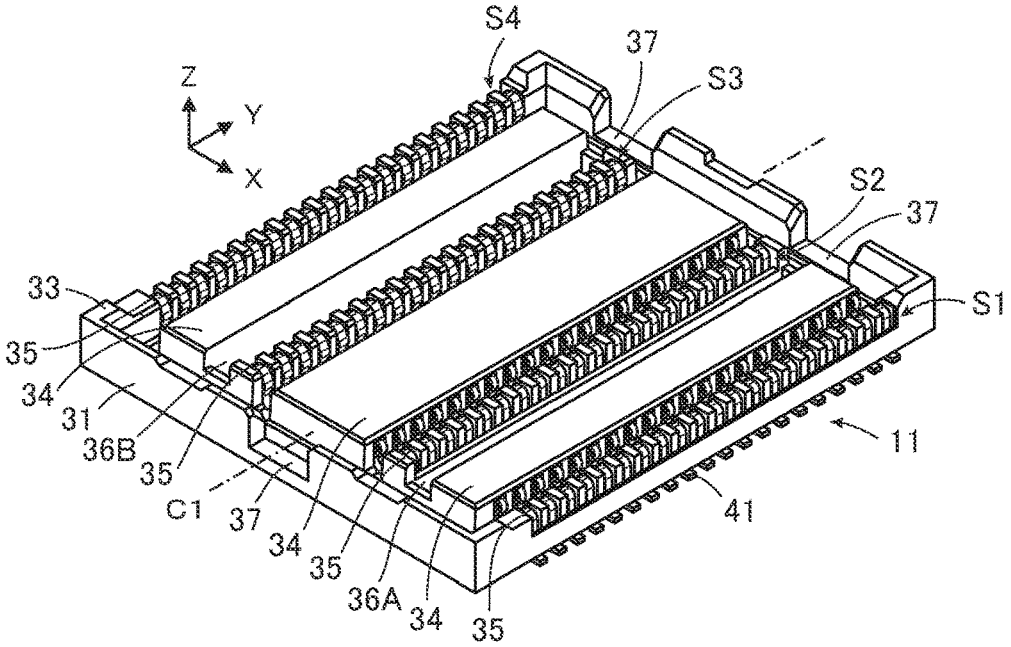
FIG. 2 is a perspective view of the receptacle connector, when viewed from an obliquely upper position.
Figure 3:
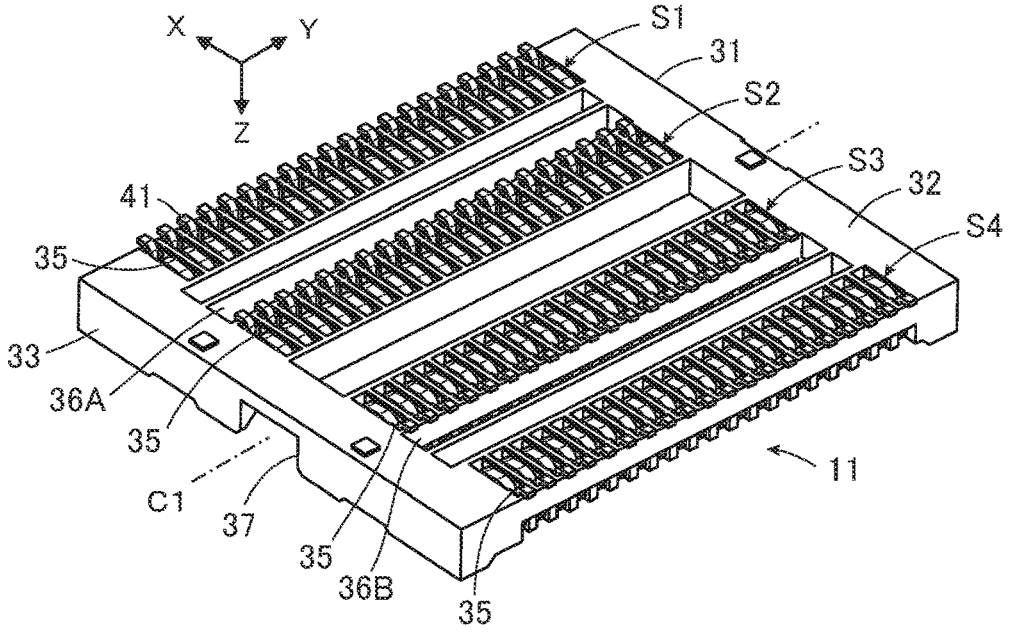
FIG. 3 is a perspective view of the receptacle connector, when viewed from an obliquely lower position.
Figure 4:
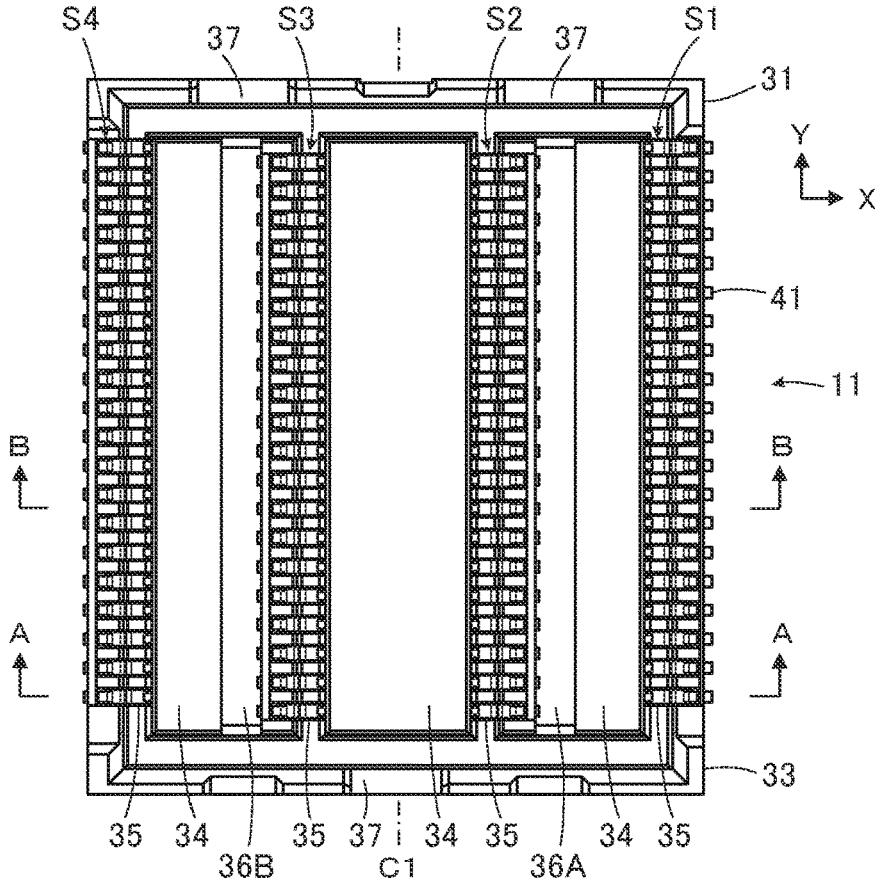
FIG. 4 is a plan view showing the receptacle connector.

The receptacle connector 11 is able to fit with the plug connector 21 serving as a counter connector, and as shown in FIGS. 2 to 4, has a center line C1 extending in the Y direction. In the receptacle connector 11, the contact arrays S1 and S2 are disposed on the +X direction side of the center line C1, and the contact arrays S3 and S4 are disposed on the −X direction side of the center line C1.

The receptacle housing 31 of the receptacle connector 11 is made of an insulating body such as insulating resin, has a substantially flat plate shape, and includes a flat surface portion 32 extending along an XY plane on the −Z side of the receptacle housing 31. A peripheral wall portion 33 protruding in the +Z direction is formed along the outer periphery of the flat surface portion 32, and three projecting portions 34 are formed in the area surrounded by the peripheral wall portion 33 and project in the +Z direction from the flat surface portion 32 while extending in the Y direction in parallel to each other. The three projecting portions 34 have the same length in the Y direction, and one projecting portion 34 situated in the middle in the X direction is wider in the X direction than each of the projecting portions 34 situated in the opposite sides in the X direction.

The receptacle housing 31 has four contact array retaining portions 35 disposed separately on the +X direction side of, among the three projecting portions 34, the projecting portion 34 furthest on the +X direction side, on the +X direction side and the −X direction side of the projecting portion 34 situated in the middle in the X direction, and on the −X direction side of the projecting portion 34 furthest on the −X direction side. The four contact array retaining portions 35 extend in the Y direction and separately retain the contact arrays S1 to S4.

In the receptacle housing 31, an opening portion 36A extending in the Y direction and penetrating the receptacle housing 31 in the Z direction is formed between the contact array retaining portion 35 disposed on the +X direction side of the projecting portion 34 situated in the middle in the X direction and the projecting portion 34 furthest on the +X direction side. Similarly, an opening portion 36B extending in the Y direction and penetrating the receptacle housing 31 in the Z direction is formed between the contact array retaining portion 35 disposed on the −X direction side of the projecting portion 34 situated in the middle in the X direction and the projecting portion 34 furthest on the −X direction side.

Two positioning recess portions 37 are formed in the peripheral wall portion 33 at the +Y directional end of the receptacle housing 31 at a certain interval in the X direction to open in the +Z direction, while one positioning recess portion 37 is formed in the peripheral wall portion 33 at the −Y directional end of the receptacle housing 31 to open in the +Z direction.

Figure 5:
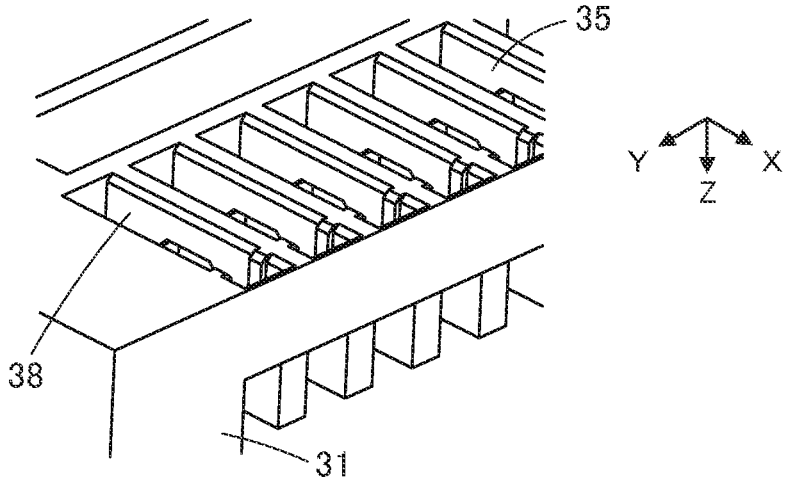
FIG. 5 is an enlarged partial perspective view showing a receptacle housing used in the receptacle connector.
Figure 6:
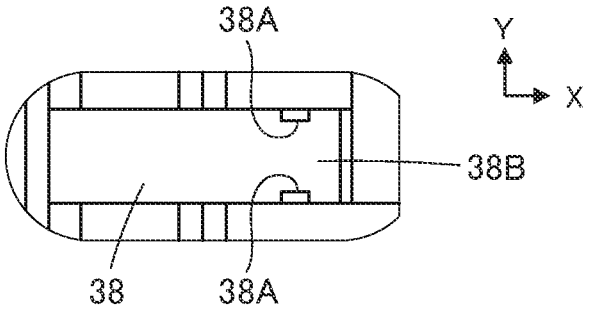
FIG. 6 is a plan view showing a connector accommodating groove of the receptacle housing used in the receptacle connector.

As shown in FIG. 5, each contact array retaining portion 35 has a plurality of contact accommodating grooves 38 aligned in the Y direction. Each contact accommodating groove 38 extends in the X direction and opens in the −Z direction. As shown in FIG. 6, the contact accommodating groove 38 is provided in its inside with a pair of projections 38A that project separately from the inner surfaces on the +Y and −Y direction sides of the contact accommodating groove 38 such that the tips of the projections 38A face each other. Those projections 38A and an X directional end of the contact accommodating groove 38 constitute a retaining portion 38B for retaining the corresponding receptacle contact 41.

Figure 7:
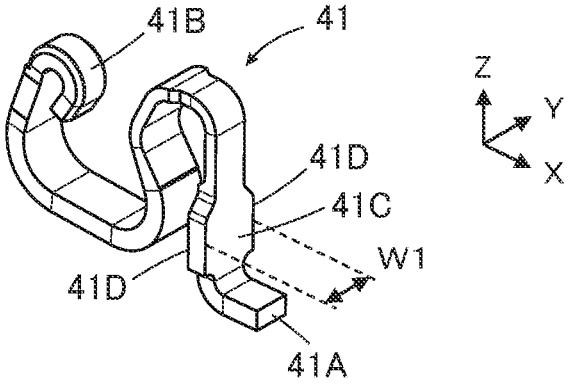
FIG. 7 is a perspective view showing a receptacle contact used in the receptacle connector.

As shown in FIG. 7, the receptacle contact 41 is formed by bending a band-shaped metal plate having electrical conductivity, and has a mounting portion 41A at its one end and a contact portion 41B at its other end. The mounting portion 41A extends along an XY plane and, when the receptacle connector 11 is mounted onto a mounting object such as a circuit board, is joined and fixed to a connecting pad or the like of the mounting object. Meanwhile, the contact portion 41B is a spring contact that is elastically displaceable in the X direction and when the receptacle connector 11 is connected to the plug connector 21 serving as the counter connector, comes into contact with the corresponding plug contact 61 of the plug connector 21.

The receptacle contact 41 further has a portion to be retained 41C between the mounting portion 41A and the contact portion 41B. The portion to be retained 41C has a pair of jutting portions 41D jutting separately in the +Y direction and the −Y direction from the band-shaped metal plate forming the receptacle contact 41. By press-fitting the portion to be retained 41C having the jutting portions 41D into the retaining portion 38B of the corresponding contact accommodating groove 38 of the receptacle housing 31 from the −Z direction side, the receptacle contact 41 is retained by the contact accommodating groove 38.

The receptacle contact 41 has a larger width in the Y direction at the pair of jutting portions 41D than that at the other portions, and the width in the Y direction of the receptacle contact 41 at the pair of jutting portions 41D is defined as a contact width W1.

Figure 8:
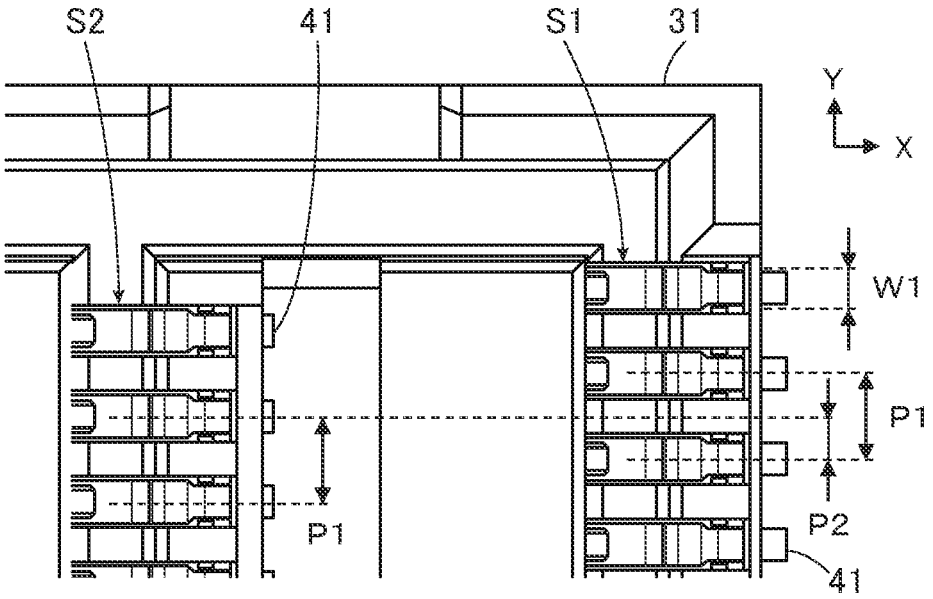
FIG. 8 is an enlarged partial plan view of the receptacle connector.

As shown in FIG. 8, the receptacle contacts 41 constituting each of the contact arrays S1 to S4 are aligned in the Y direction at a predetermined array pitch P1, and the adjacent contact arrays S1 and S2 are arranged to be offset from each other in the Y direction by an offset amount P2 equal to a half of the array pitch P1. The array pitch P1 is set to be larger than a double of the contact width W1 of the receptacle contact 41. In other words, the offset amount P2 equal to a half of the array pitch P1 is set to be larger than the contact width W1 of the receptacle contact 41.

Accordingly, the receptacle contacts 41 constituting the contact array S1 and the receptacle contacts 41 constituting the contact array S2 are arranged to be offset from each other in the Y direction by the offset amount P2 and do not overlap each other at all in the X direction perpendicular to the Y direction.

As can be seen from FIG. 4, the adjacent contact arrays S3 and S4 are also arranged to be offset from each other in the Y direction by the offset amount P2. The receptacle contacts 41 constituting the contact array S3 and the receptacle contacts 41 constituting the contact array S4 are arranged to be offset from each other in the Y direction by the offset amount P2 and do not overlap each other at all in the X direction perpendicular to the Y direction.

The contact arrays S1 and S4 are disposed at the same position in the Y direction with no offset, and the contact arrays S2 and S3 are also disposed at the same position in the Y direction with no offset.

Figure 9:
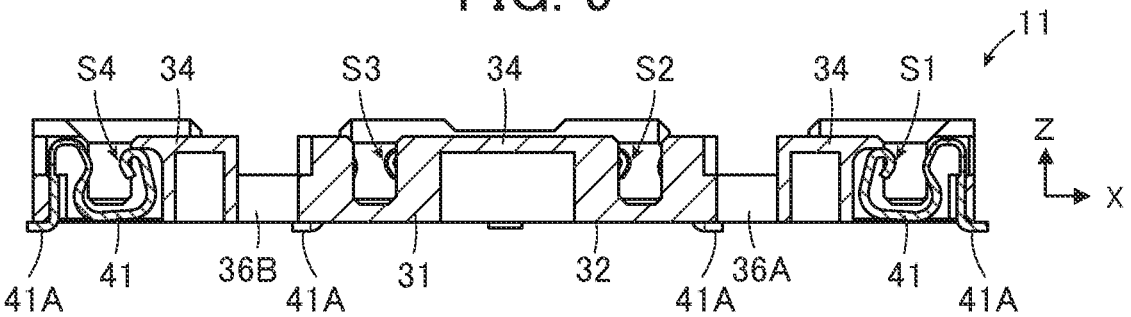
FIG. 9 is a cross-sectional view taken along line A-A in FIG. 4.

Therefore, when the receptacle connector 11 is cut along an XZ plane passing through given receptacle contacts 41 of the contact arrays S1 and S4, as shown in FIG. 9, the receptacle contact 41 of the contact array S1 and the receptacle contact 41 of the contact array S4 appear in the cross section, whereas for the contact arrays S2 and S3, no receptacle contact 41 appears in the cross section with only a section of the receptacle housing 31 being seen.

Figure 10:
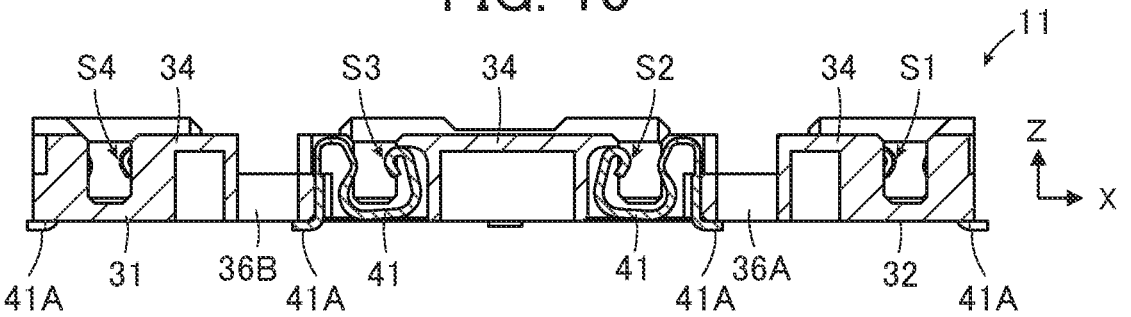
FIG. 10 is a cross-sectional view taken along line B-B in FIG. 4.

Similarly, when the receptacle connector 11 is cut along an XZ plane passing through given receptacle contacts 41 of the contact arrays S2 and S3, as shown in FIG. 10, the receptacle contact 41 of the contact array S2 and the receptacle contact 41 of the contact array S3 appear in the cross section, whereas for the contact arrays S1 and S4, no receptacle contact 41 appears in the cross section with only a section of the receptacle housing 31 being seen.

On the +X direction side in the receptacle connector 11, all of the mounting portions 41A of the receptacle contacts 41 of the adjacent contact arrays S1 and S2 extend in the +X direction, which is an elongation direction, along the flat surface portion 32 of the receptacle housing 31. All of the mounting portions 41A of the receptacle contacts 41 of the contact array S1 protrude in the +X direction from the +X directional end of the receptacle housing 31, and all of the mounting portions 41A of the receptacle contacts 41 of the contact array S2 protrude in the opening portion 36A of the receptacle housing 31 that is situated on the +X direction side of the contact array S2.

Similarly, on the −X direction side in the receptacle connector 11, all of the mounting portions 41A of the receptacle contacts 41 of the adjacent contact arrays S3 and S4 extend in the −X direction, which is an elongation direction, along an XY plane. All of the mounting portions 41A of the receptacle contacts 41 of the contact array S3 protrude in the opening portion 36B of the receptacle housing 31 that is situated on the −X direction side of the contact array S3, and all of the mounting portions 41A of the receptacle contacts 41 of the contact array S4 protrude in the −X direction from the −X directional end of the receptacle housing 31.

Figure 11:
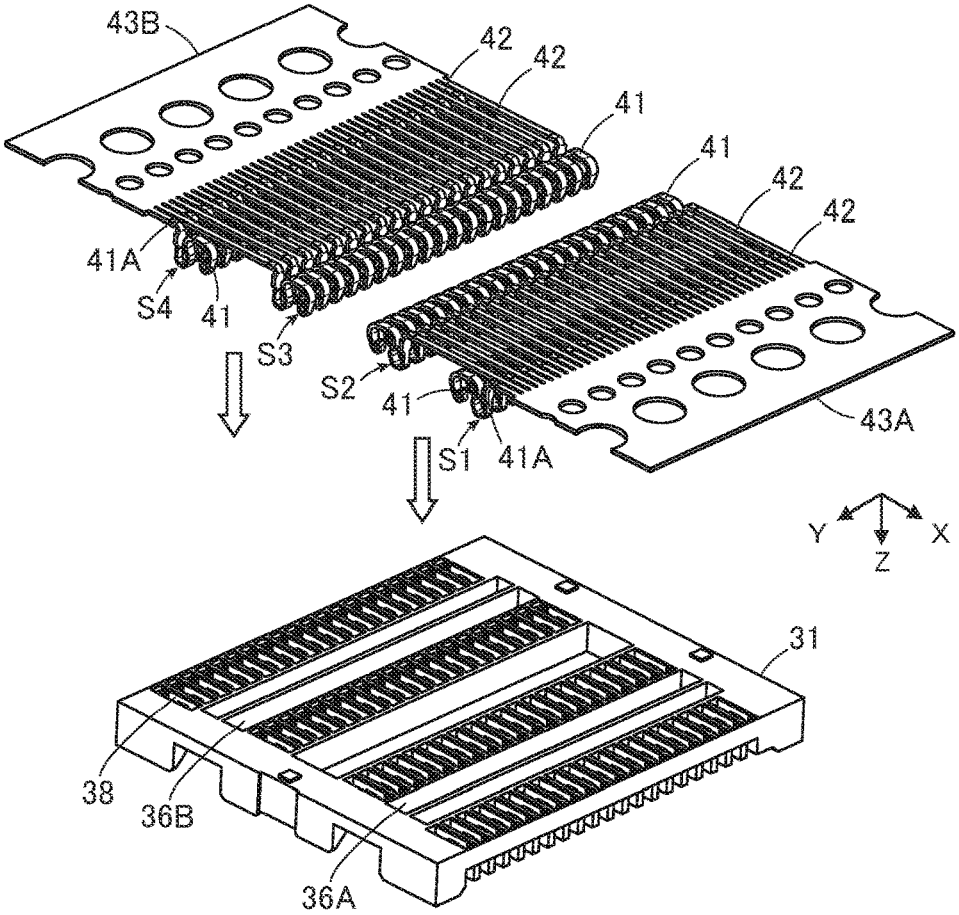
FIG. 11 is a view showing a step of attaching receptacle contacts joined to carriers to the receptacle housing.

A method of manufacturing the receptacle connector 11 as above is described. As shown in FIG. 11, the receptacle contacts 41 constituting the contact array S1 and the receptacle contacts 41 constituting the contact array S2 are joined to a single carrier 43A via associated joint portions 42, and the receptacle contacts 41 constituting the contact array S4 and the receptacle contacts 41 constituting the contact array S3 are joined to another single carrier 43B via associated joint portions 42. The joint portions 42 connect the mounting portions 41A of the respective receptacle contacts 41 to the corresponding carrier 43A or 43B.

Note that, as shown in FIG. 8, the receptacle contacts 41 constituting the contact array S1 and the receptacle contacts 41 constituting the contact array S2 are arranged so as not to overlap each other in the X direction. This configuration allows the receptacle contacts 41 constituting the contact array S1 and the receptacle contacts 41 constituting the contact array S2 to be joined to the single carrier 43A.

Similarly, the receptacle contacts 41 constituting the contact array S4 and the receptacle contacts 41 constituting the contact array S3 are arranged so as not to overlap each other in the X direction. This configuration allows the receptacle contacts 41 constituting the contact array S4 and the receptacle contacts 41 constituting the contact array S3 to be joined to the other single carrier 43B.

When the two carriers 43A and 43B are moved toward the receptacle housing 31 from the −Z direction side to the +Z direction side, the receptacle contacts 41 of the contact arrays S1 to S4 are fitted and accommodated into the corresponding contact accommodating grooves 38 of the receptacle housing 31. At this time, the portion to be retained 41C having the pair of jutting portions 41D shown in FIG. 7 in each receptacle contact 41 is press-fitted into and retained by the retaining portion 38B of the corresponding contact accommodating groove 38 shown in FIG. 6.

Figure 12:
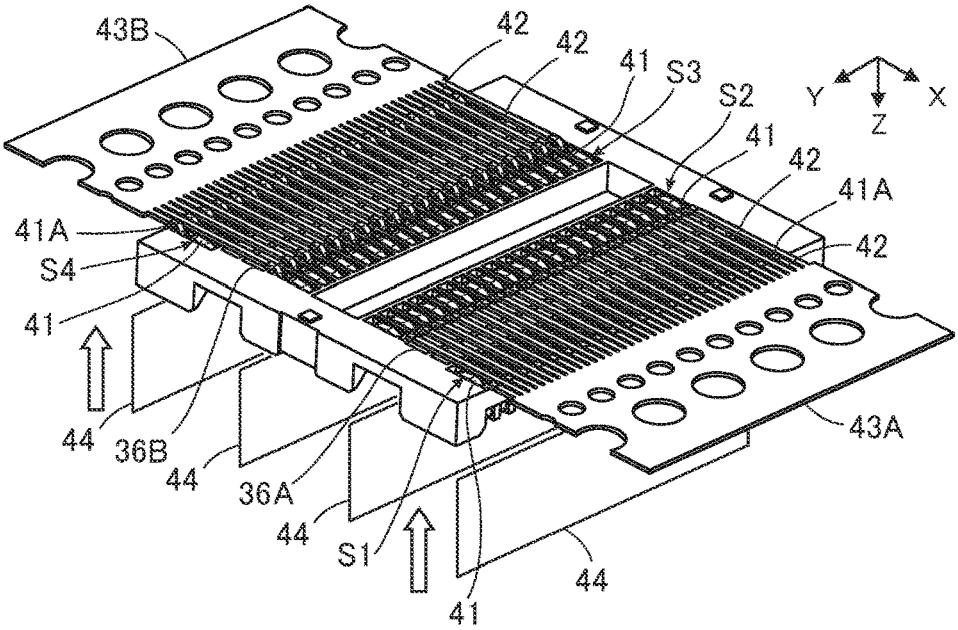
FIG. 12 is a view showing a step of separating the carriers from the receptacle contacts attached to the receptacle housing.

Thus, as shown in FIG. 12, all of the receptacle contacts 41 of the contact arrays S1 to S4 can be press-fitted together into the receptacle housing 31 by means of the two carriers 43A and 43B in one step.

The joint portions 42 connecting the receptacle contacts 41 of the contact array S1 to the carrier 43A extend in the +X direction from the +X directional end of the receptacle housing 31, and the joint portions 42 connecting the receptacle contacts 41 of the contact array S2 to the carrier 43A extend across the opening portion 36A of the receptacle housing 31 that is situated on the +X direction side of the contact array S2 and further extend in the +X direction from the +X directional end of the receptacle housing 31.

In contrast, the joint portions 42 connecting the receptacle contacts 41 of the contact array S4 to the carrier 43B extend from the −X directional end of the receptacle housing 31 toward the −X direction, and the joint portions 42 connecting the receptacle contacts 41 of the contact array S3 to the carrier 43B extend across the opening portion 36B of the receptacle housing 31 that is situated on the −X direction side of the contact array S3 and further extend from the −X directional end of the receptacle housing 31 toward the −X direction.

Next, as shown in FIG. 12, the receptacle contacts 41 are separated from the two carriers 43A and 43B by means of four carrier separating tools 44. Each of the four carrier separating tools 44 is a plate member extending along a YZ plane and is provided at its −Z directional end with a blade portion extending along the Y direction. The four carrier separating tools 44 are arranged at intervals in the X direction.

Of the four carrier separating tools 44, the carrier separating tool 44 situated furthest on the +X direction side is disposed slightly away from the +X directional end of the receptacle housing 31 in the +X direction, and the carrier separating tool 44 situated furthest on the −X direction side is disposed slightly away from the −X directional end of the receptacle housing 31 in the −X direction.

Further, of the four carrier separating tools 44, the carrier separating tool 44 that is the second from the end on the +X direction side is disposed at a position corresponding to the opening portion 36A of the receptacle housing 31 that is situated on the +X direction side of the contact array S2, and the carrier separating tool 44 that is the second from the end on the −X direction side is disposed at a position corresponding to the opening portion 36B of the receptacle housing 31 that is situated on the −X direction side of the contact array S3.

The four carrier separating tools 44 as above are moved from the +Z direction side toward the −Z direction side, and the blade portions at the −Z directional ends of the carrier separating tools 44 are each pressed to the joint portions 42 of the corresponding carrier 43A or 43B; as a result, the joint portions 42 are cut, and the receptacle contacts 41 are separated from the carrier 43A or 43B.

In this process, of the four carrier separating tools 44, the carrier separating tool 44 situated furthest on the +X direction side is moved in the −Z direction along a course slightly away from the +X directional end of the receptacle housing 31 in the +X direction, whereby the receptacle contacts 41 of the contact array S1 are separated from the carrier 43A, and the carrier separating tool 44 that is the second from the end on the +X direction side is moved in the −Z direction through the opening portion 36A of the receptacle housing 31, whereby the receptacle contacts 41 of the contact array S2 are separated from the carrier 43A.

Since the receptacle contacts 41 of the contact array S1 and the receptacle contacts 41 of the contact array S2 are joined to the carrier 43A situated on the +X direction side of the receptacle housing 31 via the corresponding joint portions 42, once the joint portions 42 are cut, consequently, the mounting portions 41A of the receptacle contacts 41 of the contact array S1 all extend in the +X direction so as to protrude from the +X directional end of the receptacle housing 31, and the mounting portions 41A of the receptacle contacts 41 of the contact array S2 all extend in the +X direction so as to protrude in the opening portion 36A of the receptacle housing 31.

Further, of the four carrier separating tools 44, the carrier separating tool 44 situated furthest on the −X direction side is moved in the −Z direction along a course slightly away from the −X directional end of the receptacle housing 31 in the −X direction, whereby the receptacle contacts 41 of the contact array S4 are separated from the carrier 43B, and the carrier separating tool 44 that is the second from the end on the −X direction side is moved in the −Z direction through the opening portion 36B of the receptacle housing 31 that is situated on the −X direction side of the contact array S3, whereby the receptacle contacts 41 of the contact array S3 are separated from the carrier 43B.

Since the receptacle contacts 41 of the contact array S4 and the receptacle contacts 41 of the contact array S3 are joined to the carrier 43B situated on the −X direction side of the receptacle housing 31 via the corresponding joint portions 42, once the joint portions 42 are cut, consequently, the mounting portions 41A of the receptacle contacts 41 of the contact array S4 all extend in the −X direction so as to protrude from the −X directional end of the receptacle housing 31, and the mounting portions 41A of the receptacle contacts 41 of the contact array S3 all extend in the −X direction so as to protrude in the opening portion 36B of the receptacle housing 31.

Thus, all of the receptacle contacts 41 of the contact arrays S1 to S4 can be separated together from the carriers 43A and 43B by means of the four carrier separating tools 44 in one step.

The foregoing method makes it possible to manufacture the receptacle connector 11 having a large number of receptacle contacts 41 with fewer manufacturing steps.

Figure 13:
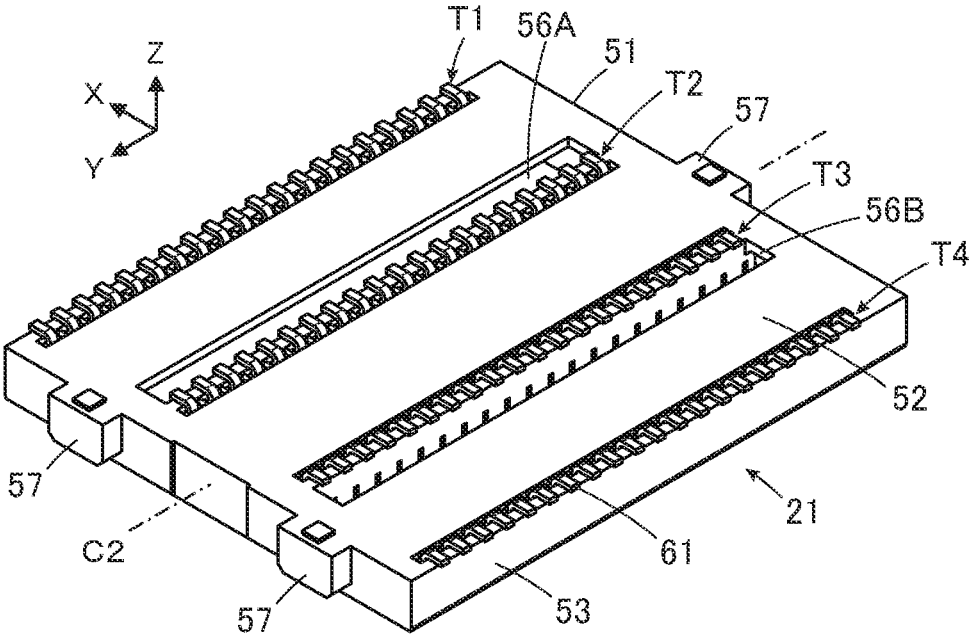
FIG. 13 is a perspective view of the plug connector, when viewed from an obliquely upper position.
Figure 14:
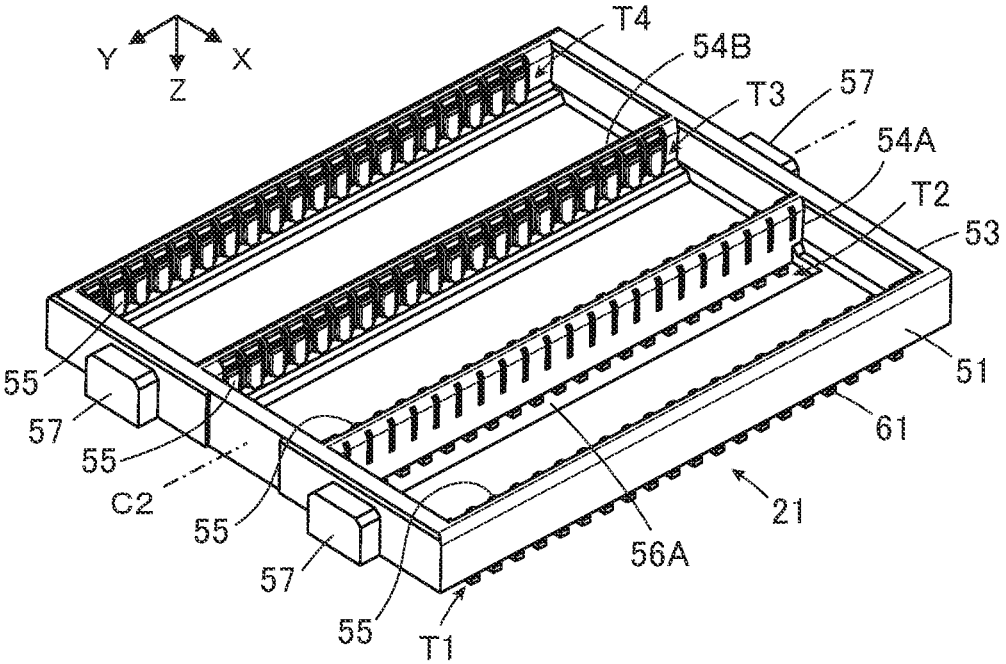
FIG. 14 is a perspective view of the plug connector, when viewed from an obliquely lower position.
Figure 15:
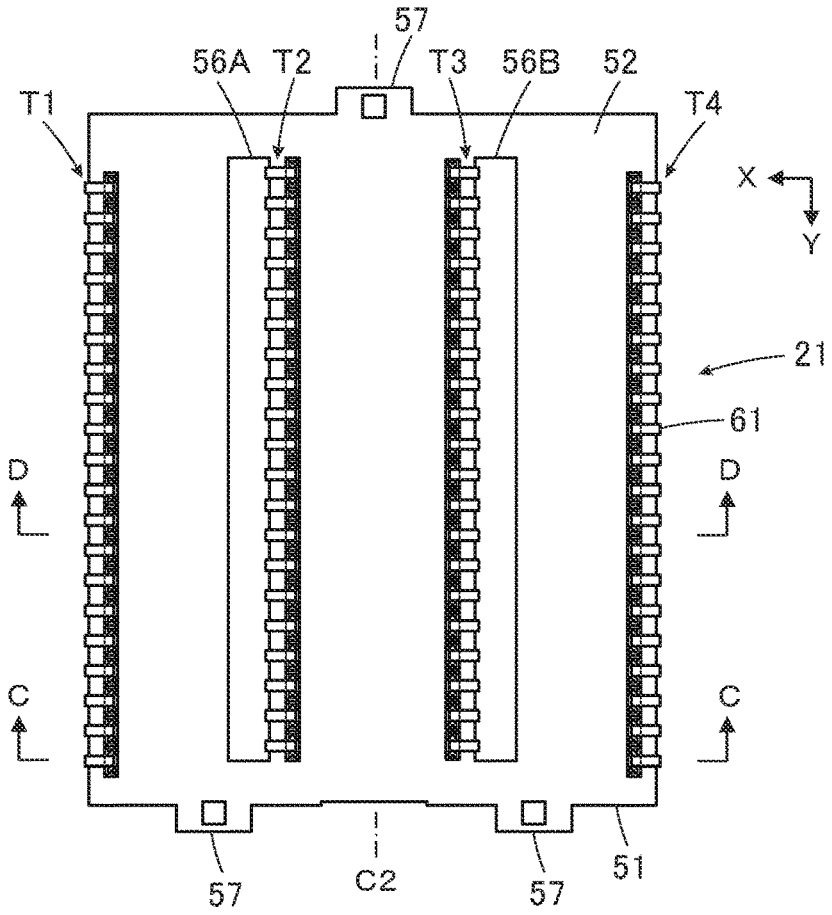
FIG. 15 is a plan view showing the plug connector.

The plug connector 21 is able to fit with the receptacle connector 11 serving as a counter connector, and as shown in FIGS. 13 to 15, has a center line C2 extending in the Y direction. In the plug connector 21, the contact arrays T1 and T2 are disposed on the +X direction side of the center line C2, and the contact arrays T3 and T4 are disposed on the −X direction side of the center line C2.

The plug housing 51 of the plug connector 21 is made of an insulating body such as insulating resin, has a substantially flat plate shape, and includes a flat surface portion 52 extending along an XY plane on the +Z side of the plug housing 51. A peripheral wall portion 53 protruding in the −Z direction is formed along the outer periphery of the flat surface portion 52, and two partition portions 54A and 54B are formed in the area surrounded by the peripheral wall portion 53 and project in the −Z direction from the flat surface portion 52 while extending in the Y direction in parallel to each other.

The plug housing 51 has four contact array retaining portions 55 disposed separately on the −X direction side of the +X directional part of the peripheral wall portion 53, on the −X direction side of the partition portion 54A situated on the +X direction side, on the +X direction side of the partition portion 54B situated on the −X direction side, and on the +X direction side of the −X directional part of the peripheral wall portion 53. The four contact array retaining portions 55 extend in the Y direction and separately retain the contact arrays T1 to T4.

In the plug housing 51, an opening portion 56A extending in the Y direction and penetrating the plug housing 51 in the Z direction is formed on the +X direction side of the partition portion 54A situated on the +X direction side, and an opening portion 56B extending in the Y direction and penetrating the plug housing 51 in the Z direction is formed on the −X direction side of the partition portion 54B situated on the −X direction side.

Two positioning projection portions 57 are formed on the peripheral wall portion 53 at the +Y directional end of the plug housing 51 at a certain interval in the X direction to project in the +Y direction, while one positioning projection portion 57 is formed on the peripheral wall portion 53 at the −Y directional end of the plug housing 51 to project in the +Y direction.

Figure 16:
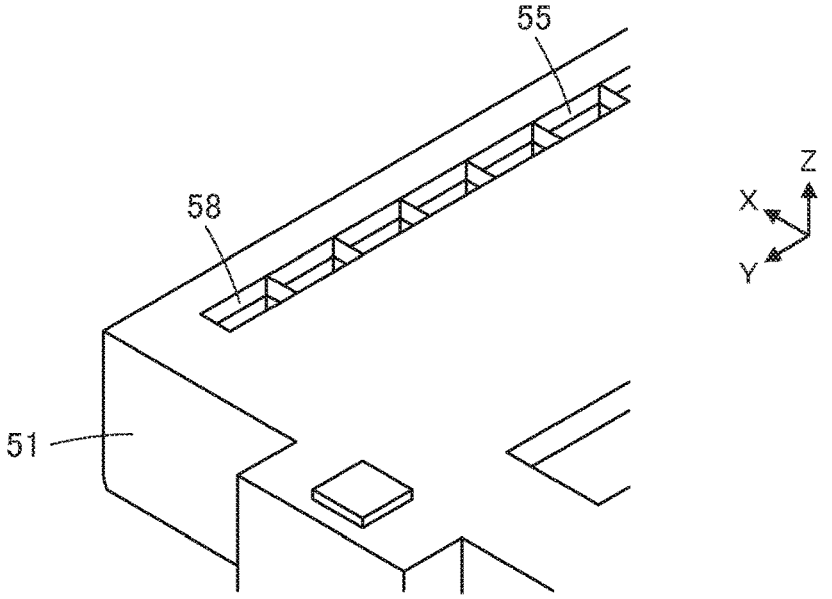
FIG. 16 is an enlarged partial perspective view showing a plug housing used in the plug connector.

As shown in FIG. 16, each contact array retaining portion 55 has a plurality of contact accommodating grooves 58 aligned in the Y direction. Although not illustrated, each contact accommodating groove 58 is provided in its inside with a retaining portion for retaining the corresponding plug contact 61.

Figure 17:
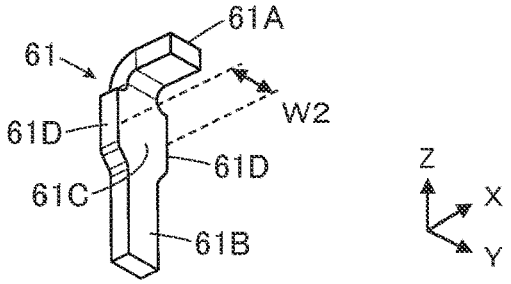
FIG. 17 is a perspective view showing a plug contact used in the plug connector.

As shown in FIG. 17, the plug contact 61 is formed by bending a band-shaped metal plate having electrical conductivity, and has a mounting portion 61A at its one end and a contact portion 61B at its other end. The mounting portion 61A extends along an XY plane and, when the plug connector 21 is mounted onto a mounting object such as a circuit board, is joined and fixed to a connecting pad or the like of the mounting object. Meanwhile, the contact portion 61B is a fixed contact that is not elastically displaceable and, when the plug connector 21 is connected to the receptacle connector 11 serving as the counter connector, comes into contact with the corresponding receptacle contact 41 of the receptacle connector 11.

The plug contact 61 further has a portion to be retained 61C between the mounting portion 61A and the contact portion 61B. The portion to be retained 61C has a pair of jutting portions 61D jutting separately in the +Y direction and the −Y direction from the band-shaped metal plate forming the plug contact 61. By press-fitting the portion to be retained 61C having the jutting portions 61D into the retaining portion of the corresponding contact accommodating groove 58 of the plug housing 51 from the +Z direction side, the plug contact 61 is retained by the contact accommodating groove 58.

The plug contact 61 has a larger width in the Y direction at the pair of jutting portions 61D than that at the other portions, and the width in the Y direction of the plug contact 61 at the pair of jutting portions 61D is defined as a contact width W2.

Figure 18:
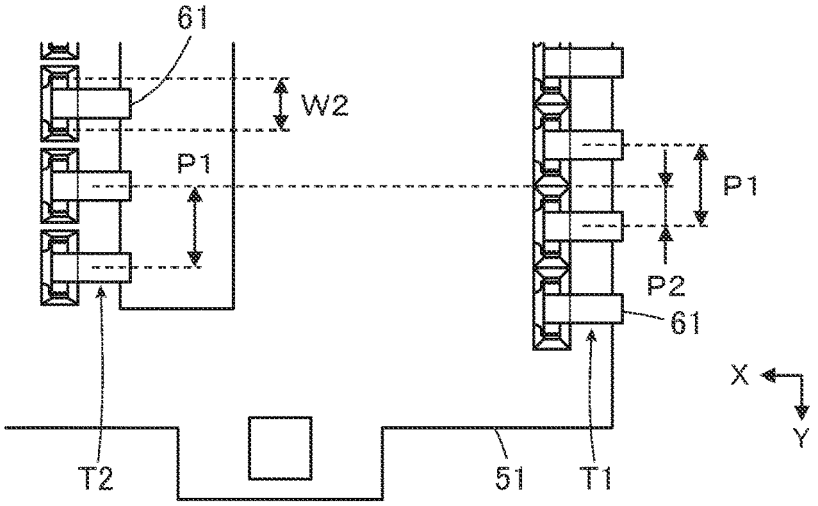
FIG. 18 is an enlarged partial plan view of the plug connector.

As shown in FIG. 18, the plug contacts 61 constituting each of the contact arrays T1 to T4 are aligned in the Y direction at the same array pitch P1 as that of the receptacle contacts 41 of the receptacle connector 11, and the adjacent contact arrays T1 and T2 are arranged to be offset from each other in the Y direction by the offset amount P2 equal to a half of the array pitch P1. The array pitch P1 is set to be larger than a double of the contact width W2 of the plug contact 61. In other words, the offset amount P2 equal to a half of the array pitch P1 is set to be larger than the contact width W2 of the plug contact 61.

Accordingly, the plug contacts 61 constituting the contact array T1 and the plug contacts 61 constituting the contact array T2 are arranged to be offset from each other in the Y direction by the offset amount P2 and do not overlap each other at all in the X direction perpendicular to the Y direction.

The adjacent contact arrays T3 and T4 are also arranged to be offset from each other in the Y direction by the offset amount P2. The plug contacts 61 constituting the contact array T3 and the plug contacts 61 constituting the contact array T4 are arranged to be offset from each other in the Y direction by the offset amount P2 and do not overlap each other at all in the X direction perpendicular to the Y direction.

The contact arrays T1 and T4 are disposed at the same position in the Y direction with no offset, and the contact arrays T2 and T3 are also disposed at the same position in the Y direction with no offset.

Figure 19:
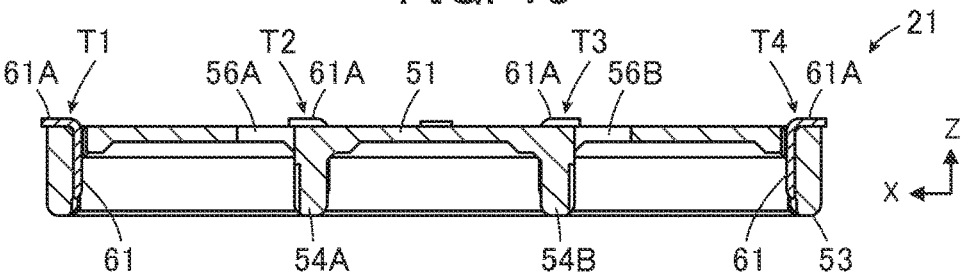
FIG. 19 is a cross-sectional view taken along line C-C in FIG. 15.

Therefore, when the plug connector 21 is cut along an XZ plane passing through given plug contacts 61 of the contact arrays T1 and T4, as shown in FIG. 19, the plug contact 61 of the contact array T1 and the plug contact 61 of the contact array T4 appear in the cross section, whereas for the contact arrays T2 and T3, no plug contact 61 appears in the cross section with only a section of the plug housing 51 being seen.

Figure 20:
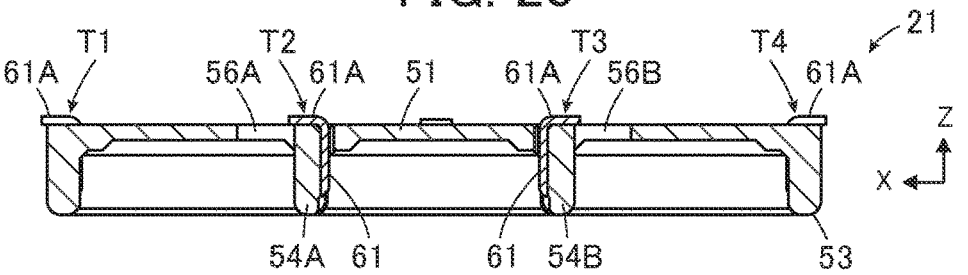
FIG. 20 is a cross-sectional view taken along line D-D in FIG. 15.

Similarly, when the plug connector 21 is cut along an XZ plane passing through given plug contacts 61 of the contact arrays T2 and T3, as shown in FIG. 20, the plug contact 61 of the contact array T2 and the plug contact 61 of the contact array T3 appear in the cross section, whereas for the contact arrays T1 and T4, no plug contact 61 appears in the cross section with only a section of the plug housing 51 being seen.

On the +X direction side in the plug connector 21, all of the mounting portions 61A of the plug contacts 61 of the adjacent contact arrays T1 and T2 extend in the +X direction, which is an elongation direction, along the flat surface portion 52 of the plug housing 51. All of the mounting portions 61A of the plug contacts 61 of the contact array T1 protrude in the +X direction from the +X directional end of the plug housing 51, and all of the mounting portions 61A of the plug contacts 61 of the contact array T2 protrude in the opening portion 56A of the plug housing 51 that is situated on the +X direction side of the contact array T2.

Similarly, on the −X direction side in the plug connector 21, all of the mounting portions 61A of the plug contacts 61 of the adjacent contact arrays T3 and T4 extend in the −X direction, which is an elongation direction, along an XY plane. All of the mounting portions 61A of the plug contacts 61 of the contact array T3 protrude in the opening portion 56B of the plug housing 51 that is situated on the −X direction side of the contact array T3, and all of the mounting portions 61A of the plug contacts 61 of the contact array T4 protrude in the −X direction from the −X directional end of the plug housing 51.

Figure 21:
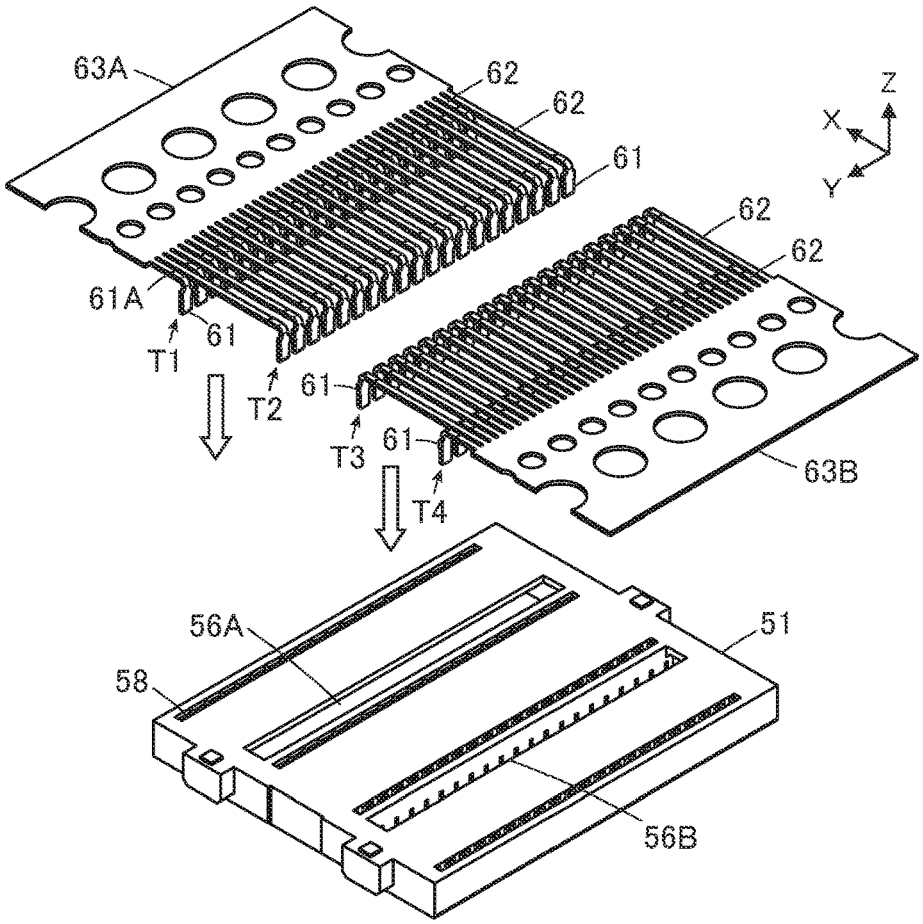
FIG. 21 is a view showing a step of attaching plug contacts joined to carriers to the plug housing.

A method of manufacturing the plug connector 21 as above is described. As shown in FIG. 21, the plug contacts 61 constituting the contact array T1 and the plug contacts 61 constituting the contact array T2 are joined to a single carrier 63A via associated joint portions 62, and the plug contacts 61 constituting the contact array T4 and the plug contacts 61 constituting the contact array T3 are joined to another single carrier 63B via associated joint portions 62. The joint portions 62 connect the mounting portions 61A of the respective plug contacts 61 to the corresponding carrier 63A or 63B.

Note that, as shown in FIG. 18, the plug contacts 61 constituting the contact array T1 and the plug contacts 61 constituting the contact array T2 are arranged so as not to overlap each other in the X direction. This configuration allows the plug contacts 61 constituting the contact array T1 and the plug contacts 61 constituting the contact array T2 to be joined to the single carrier 63A.

Similarly, the plug contacts 61 constituting the contact array T4 and the plug contacts 61 constituting the contact array T3 are arranged so as not to overlap each other in the X direction. This configuration allows the plug contacts 61 constituting the contact array T4 and the plug contacts 61 constituting the contact array T3 to be joined to the other single carrier 63B.

When the two carriers 63A and 63B are moved toward the plug housing 51 from the +Z direction side to the −Z direction side, the plug contacts 61 of the contact arrays T1 to T4 are fitted and accommodated into the corresponding contact accommodating grooves 58 of the plug housing 51. At this time, the portion to be retained 61C having the pair of jutting portions 61D shown in FIG. 17 in each plug contact 61 is press-fitted into and retained by the retaining portion of the corresponding contact accommodating groove 58.

Figure 22:
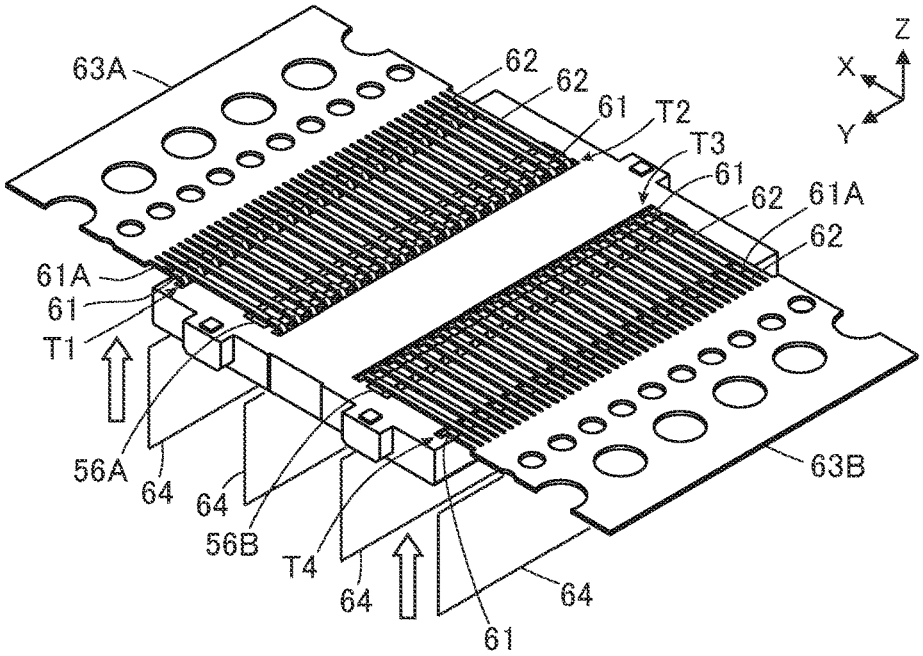
FIG. 22 is a view showing a step of separating the carriers from the plug contacts attached to the plug housing.

Thus, as shown in FIG. 22, all of the plug contacts 61 of the contact arrays T1 to T4 can be press-fitted together into the plug housing 51 by means of the two carriers 63A and 63B in one step.

The joint portions 62 connecting the plug contacts 61 of the contact array T1 to the carrier 63A extend in the +X direction from the +X directional end of the plug housing 51, and the joint portions 62 connecting the plug contacts 61 of the contact array T2 to the carrier 63A extend across the opening portion 56A of the plug housing 51 that is situated on the +X direction side of the contact array T2 and further extend in the +X direction from the +X directional end of the plug housing 51.

In contrast, the joint portions 62 connecting the plug contacts 61 of the contact array T4 to the carrier 63B extend in the −X direction from the −X directional end of the plug housing 51, and the joint portions 62 connecting the plug contacts 61 of the contact array T3 to the carrier 63B extend across the opening portion 56B of the plug housing 51 that is situated on the −X direction side of the contact array T3 and further extend in the −X direction from the −X directional end of the plug housing 51.

Next, as shown in FIG. 22, the plug contacts 61 are separated from the two carriers 63A and 63B by means of four carrier separating tools 64. Each of the four carrier separating tools 64 is a plate member extending along a YZ plane and is provided at its+Z directional end with a blade portion extending along the Y direction. The four carrier separating tools 44 are arranged at intervals in the X direction.

Of the four carrier separating tools 64, the carrier separating tool 64 situated furthest on the +X direction side is disposed slightly away from the +X directional end of the plug housing 51 in the +X direction, and the carrier separating tool 64 situated furthest on the −X direction side is disposed slightly away from the −X directional end of the plug housing 51 in the −X direction.

Further, of the four carrier separating tools 64, the carrier separating tool 64 that is the second from the end on the +X direction side is disposed at a position corresponding to the opening portion 56A of the plug housing 51 that is situated on the +X direction side of the contact array T2, and the carrier separating tool 64 that is the second from the end on the −X direction side is disposed at a position corresponding to the opening portion 56B of the plug housing 51 that is situated on the −X direction side of the contact array T3.

The four carrier separating tools 64 as above are moved from the −Z direction side toward the +Z direction side, and the blade portions at the +Z directional ends of the carrier separating tools 64 are each pressed to the joint portions 62 of the corresponding carrier 63A or 63B; as a result, the joint portions 62 are cut, and the plug contacts 61 are separated from the carrier 63A or 63B.

In this process, of the four carrier separating tools 64, the carrier separating tool 64 situated furthest on the +X direction side is moved in the +Z direction along a course slightly away from the +X directional end of the plug housing 51 in the +X direction, whereby the plug contacts 61 of the contact array T1 are separated from the carrier 63A, and the carrier separating tool 64 that is the second from the end on the +X direction side is moved in the +Z direction through the opening portion 56A of the plug housing 51, whereby the plug contacts 61 of the contact array T2 are separated from the carrier 63A.

Since the plug contacts 61 of the contact array T1 and the plug contacts 61 of the contact array T2 are joined to the carrier 63A situated on the +X direction side of the plug housing 51 via the corresponding joint portions 62, once the joint portions 62 are cut, consequently, the mounting portions 61A of the plug contacts 61 of the contact array T1 all extend in the +X direction so as to protrude from the +X directional end of the plug housing 51, and the mounting portions 61A of the plug contacts 61 of the contact array T2 all extend in the +X direction so as to protrude in the opening portion 56A of the plug housing 51.

Further, of the four carrier separating tools 64, the carrier separating tool 64 situated furthest on the −X direction side is moved in the +Z direction along a course slightly away from the −X directional end of the plug housing 51 in the −X direction, whereby the plug contacts 61 of the contact array T4 are separated from the carrier 63B, and the carrier separating tool 64 that is the second from the end on the −X direction side is moved in the +Z direction through the opening portion 56B of the plug housing 51 that is situated on the −X direction side of the contact array T3, whereby the plug contacts 61 of the contact array T3 are separated from the carrier 63B.

Since the plug contacts 61 of the contact array T4 and the plug contacts 61 of the contact array T3 are joined to the carrier 63B situated on the −X direction side of the plug housing 51 via the corresponding joint portions 62, once the joint portions 62 are cut, consequently, the mounting portions 61A of the plug contacts 61 of the contact array T4 all extend in the −X direction so as to protrude from the −X directional end of the plug housing 51, and the mounting portions 61A of the plug contacts 61 of the contact array T3 all extend in the −X direction so as to protrude in the opening portion 56B of the plug housing 51.

Thus, all of the plug contacts 61 of the contact arrays T1 to T4 can be separated together from the carriers 63A and 63B by means of the four carrier separating tools 64 in one step.

The foregoing method makes it possible to manufacture the plug connector 21 having a large number of plug contacts 61 with fewer manufacturing steps.

Figure 23:
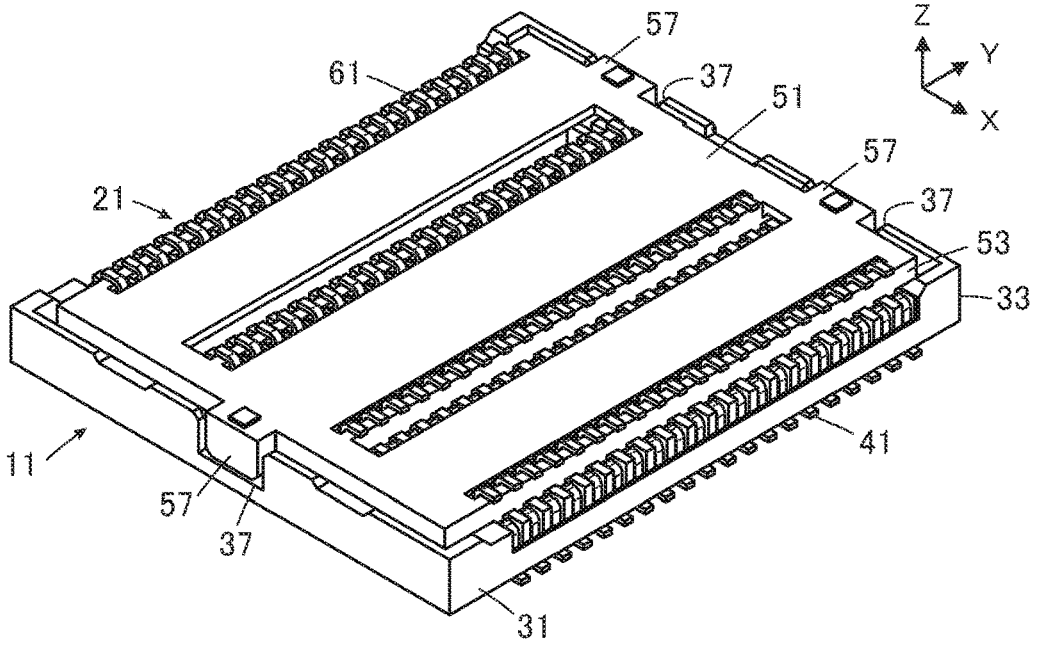
FIG. 23 is a perspective view showing the connector assembly in a fitted state.
Figure 24:
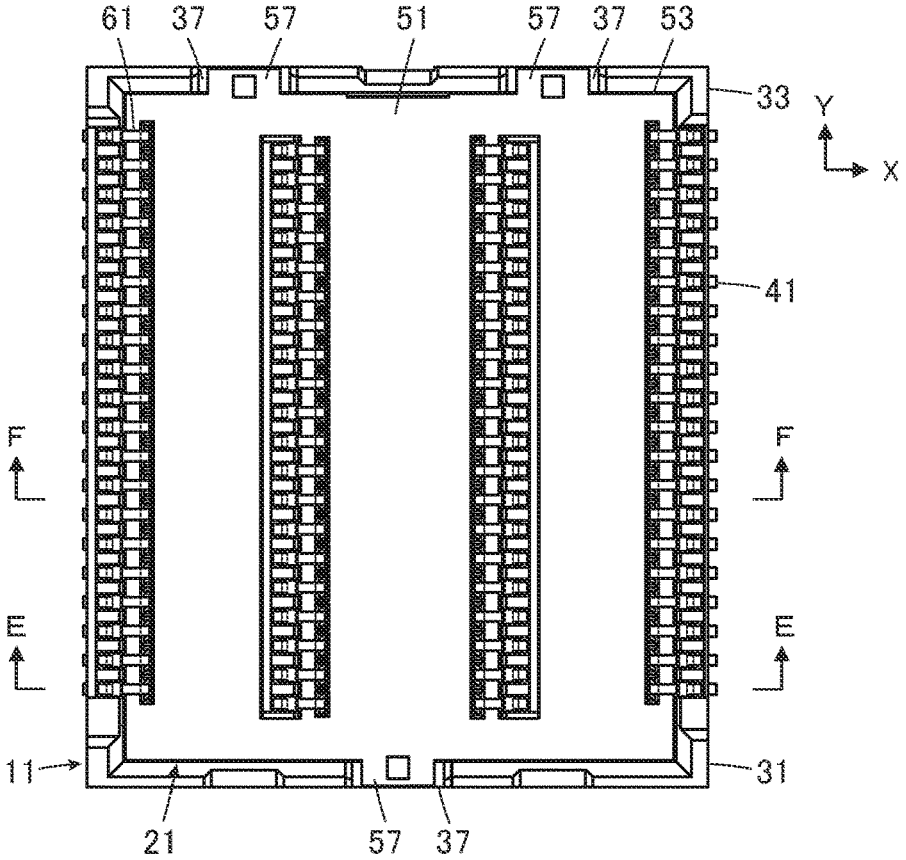
FIG. 24 is a plan view showing the connector assembly in a fitted state.

The connector assembly in the fitting state is shown in FIGS. 23 and 24. With the plug connector 21 being aligned with the receptacle connector 11, the plug connector 21 is pressed to the receptacle connector 11 in the −Z direction so that the plug connector 21 is fitted into the receptacle connector 11, thus making the connector assembly.

In the fitting state, the peripheral wall portion 53 of the plug housing 51 of the plug connector 21 enters the area surrounded by the peripheral wall portion 33 of the receptacle housing 31 of the receptacle connector 11, and the three positioning projection portions 57 of the plug connector 21 are inserted into the three positioning recess portions 37 of the receptacle connector 11, correspondingly.

Figure 25:
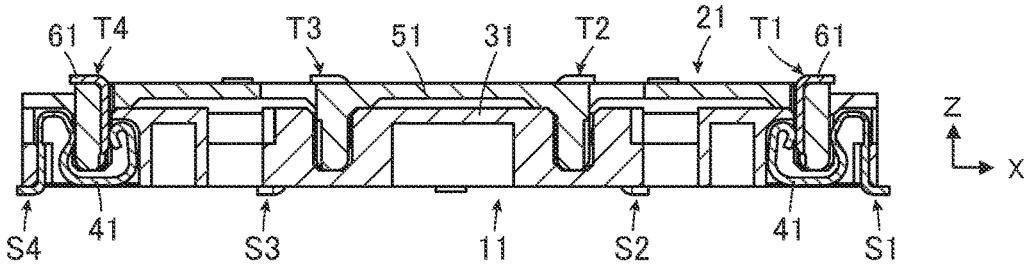
FIG. 25 is a cross-sectional view taken along line E-E in FIG. 24.

Consequently, as shown in FIG. 25, the plug contacts 61 constituting the contact arrays T1 and T4 of the plug connector 21 come into contact with the receptacle contacts 41 constituting the contact arrays S1 and S4 of the receptacle connector 11, correspondingly. Specifically, the contact portion 61B of each plug contact 61 shown in FIG. 17 comes into contact with the contact portion 41B of the corresponding receptacle contact 41 shown in FIG. 7 with predetermined contact pressure, whereby the plug contacts 61 and the receptacle contacts 41 are electrically connected to each other.

Figure 26:
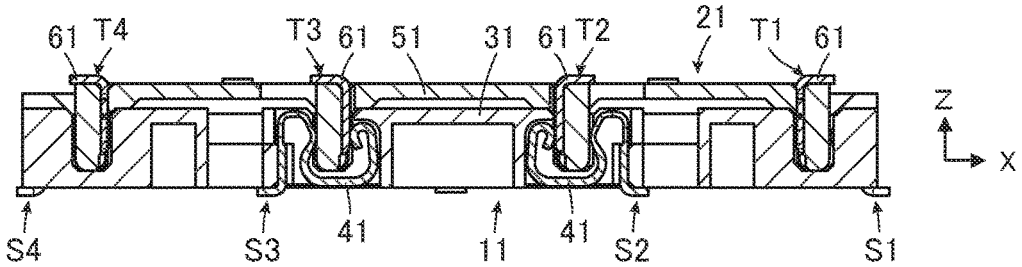
FIG. 26 is a cross-sectional view taken along line F-F in FIG. 24.
Figure 27:
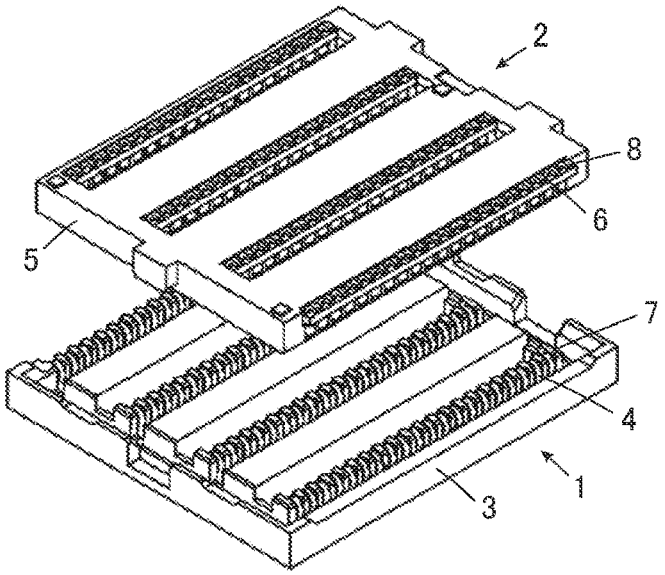
FIG. 27 PRIOR ART
FIG. 27 is a perspective view showing a conventional connector assembly before fitting.
Figure 28:
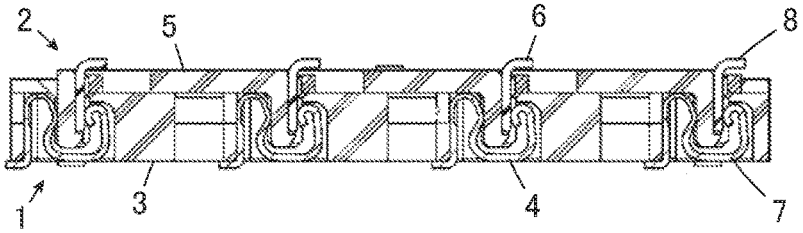
FIG. 28 PRIOR ART
FIG. 28 is a cross-sectional view of the conventional connector assembly in a fitted state.

Similarly, as shown in FIG. 26, the plug contacts 61 constituting the contact arrays T2 and T3 of the plug connector 21 come into contact with the receptacle contacts 41 constituting the contact arrays S2 and S3 of the receptacle connector 11, correspondingly, whereby the plug contacts 61 and the receptacle contacts 41 are electrically connected to each other.

Since the three positioning projection portions 57 of the plug connector 21 are inserted into the three positioning recess portions 37 of the receptacle connector 11, correspondingly, the plug connector 21 can be prevented from being fitted with the receptacle connector 11 in a wrong orientation.

In the receptacle connector 11, while the receptacle contacts 41 constituting the contact array S1 and the receptacle contacts 41 constituting the contact array S2 are arranged so as not to overlap each other at all in the X direction, it suffices if the former contacts 41 and the latter contacts 41 are in a position other than a position where the former contacts 41 and the latter contacts 41 completely coincide with each other in the X direction. The former contacts 41 and the latter contacts 41 can be joined to the single carrier 43A even when they partially overlap each other in the X direction.

For instance, when the mounting portions 41A of the receptacle contacts 41 constituting the contact array S1 and the mounting portions 41A of the receptacle contacts 41 constituting the contact array S2 are arranged to overlap each other in the X direction, and the contact portions 41B of the receptacle contacts 41 constituting the contact array S1 and the contact portions 41B of the receptacle contacts 41 constituting the contact array S2 are arranged so as not to overlap each other in the X direction, it is possible to connect the receptacle contacts 41 constituting the contact array S1 and the receptacle contacts 41 constituting the contact array S2 to the single carrier 43A.

Similarly, in the receptacle connector 11, while the receptacle contacts 41 constituting the contact array S4 and the receptacle contacts 41 constituting the contact array S3 are arranged so as not to overlap each other at all in the X direction, it suffices if the former contacts 41 and the latter contacts 41 are in a position other than a position where the former contacts 41 and the latter contacts 41 completely coincide with each other in the X direction. The former contacts 41 and the latter contacts 41 can be joined to the single carrier 43B even when they partially overlap each other in the X direction.

In the plug connector 21, it suffices if the plug contacts 61 constituting the contact array T1 and the plug contacts 61 constituting the contact array T2 do not completely coincide with each other in the X direction, and the former contacts 61 and the latter contacts 61 can be joined to the single carrier 63A even when they partially overlap each other.

Similarly, it suffices if the plug contacts 61 constituting the contact array T4 and the plug contacts 61 constituting the contact array T3 do not completely coincide with each other in the X direction, and the former contacts 61 and the latter contacts 61 can be joined to the single carrier 63B even when they partially overlap each other.

The receptacle connector 11 has the four contact arrays S1 to S4, and the plug connector 21 has the four contact arrays T1 to T4; however, the invention is not limited thereto, and it suffices if the receptacle connector 11 and the plug connector 21 each have two or more contact arrays.

For instance, when the receptacle connector 11 has only two contact arrays S1 and S2, the receptacle contacts 41 constituting the two contact arrays S1 and S2 are all joined to the single carrier 43A, so that all of the receptacle contacts 41 can be press-fitted together into the receptacle housing 31 in one step and separated together from the carrier 43A in another one step.

Similarly, when the plug connector 21 has only two contact arrays T1 and T2, the plug contacts 61 constituting the two contact arrays T1 and T2 are all joined to the single carrier 63A, so that all of the plug contacts 61 can be press-fitted together into the plug housing 51 in one step and separated together from the carrier 63A in another one step.

The number of contact arrays joined to one carrier is not limited to two, and three or more contact arrays may be joined to one carrier.

It suffices if each contact array is formed by aligning the plural receptacle contacts 41 or the plural plug contacts 61, and the number of the receptacle contacts 41 or the plug contacts 61 aligned in one contact array is not limited.

What is claimed is:

1. A connector mounted on a mounting object and connected to a counter connector, the connector comprising:

a housing; and a plurality of contacts retained by the housing, wherein the plurality of contacts form a plurality of contact arrays that linearly extend in a predetermined array direction in parallel to each other, wherein each of the plurality of contacts has a mounting portion that is fixed to the mounting object when the connector is mounted on the mounting object and a contact portion that contacts a corresponding contact of the counter connector when the connector is connected to the counter connector, wherein the mounting portions of contacts constituting at least two contact arrays adjacent to each other of the plurality of contact arrays extend in a same elongation direction, and wherein contacts constituting each contact array of the at least two contact arrays are disposed in a position other than a position where those contacts completely coincide with contacts constituting another contact array of the at least two contact arrays in a direction perpendicular to the predetermined array direction.

2. The connector according to claim 1, wherein the housing has an opening portion formed between the at least two contact arrays and extending in the predetermined array direction.

3. The connector according to claim 2, wherein the mounting portions of contacts constituting one contact array of two contact arrays situated on opposite sides across the opening portion protrude in the opening portion.

4. The connector according to claim 1, wherein the housing has a flat surface portion facing the mounting object, and wherein the elongation direction of the mounting portions of the plurality of contacts is a direction along the flat surface portion of the housing and perpendicular to the predetermined array direction.

5. The connector according to claim 1, wherein the plurality of contacts are aligned in the predetermined array direction at a predetermined array pitch in each of the plurality of contact arrays, wherein each of the plurality of contacts has a predetermined contact width in the predetermined array direction, wherein the at least two contact arrays comprise two adjacent contact arrays, wherein the two adjacent contact arrays are arranged to be offset from each other by a half of the predetermined array pitch in the predetermined array direction, and wherein the predetermined array pitch is larger than a double of the predetermined contact width.

6. The connector according to claim 1, wherein the connector has a center line extending in the predetermined array direction, and wherein the at least two contact arrays are disposed on each of opposite sides across the center line.

7. The connector according to claim 6, wherein the mounting portions of contacts constituting the at least two contact arrays disposed on one of the opposite sides across the center line and the mounting portions of contacts constituting the at least two contact arrays disposed on the other of the opposite sides across the center line extend in opposite directions from each other.

8. The connector according to claim 1, wherein the mounting portions of contacts constituting each contact array of the at least two contact arrays are disposed in a position where those mounting portions overlap the mounting portions of contacts constituting another contact array of the at least two contact arrays in the direction perpendicular to the predetermined array direction, and wherein the contact portions of contacts constituting each contact array of the at least two contact arrays are disposed in a position where those contact portions do not overlap the contact portions of contacts constituting another contact array of the at least two contact arrays in the direction perpendicular to the predetermined array direction.

9. The connector according to claim 1, wherein the contact portions of contacts constituting each contact array of the at least two contact arrays are disposed in a position where those contact portions overlap the contact portions of contacts constituting another contact array of the at least two contact arrays in the direction perpendicular to the predetermined array direction, and wherein the mounting portions of contacts constituting each contact array of the at least two contact arrays are disposed in a position where those mounting portions do not overlap the mounting portions of contacts constituting another contact array of the at least two contact arrays in the direction perpendicular to the predetermined array direction.

10. The connector according to claim 1, wherein each of the plurality of contacts has a portion to be retained between the mounting portion and the contact portion, wherein the housing has a plurality of retaining portions corresponding to the portions to be retained of the plurality of contacts, and wherein the portions to be retained of the plurality of contacts are press-fitted in and retained by the plurality of retaining portions of the housing, correspondingly.

11. The connector according to claim 1, wherein the connector is a receptacle connector, wherein the housing is a receptacle housing, wherein the plurality of contacts are a plurality of receptacle contacts, wherein each of the plurality of receptacle contacts has a spring contact that is elastically displaceable as the contact portion, and wherein the counter connector is a plug connector that is to be fitted with the receptacle connector to thereby form a connector assembly together with the receptacle connector.

12. The connector according to claim 1, wherein the connector is a plug connector, wherein the housing is a plug housing, wherein the plurality of contacts are a plurality of plug contacts, wherein each of the plurality of plug contacts has a fixed contact that is secured in position as the contact portion, and wherein the counter connector is a receptacle connector that is to be fitted with the plug connector to thereby form a connector assembly together with the plug connector.

13. A method of manufacturing a connector, comprising:

a step of retaining a plurality of contacts joined to a carrier via corresponding joint portions by a housing; and a step of separating the carrier from the plurality of contacts retained by the housing, wherein the plurality of contacts form a plurality of contact arrays that linearly extend in a predetermined array direction in parallel to each other, wherein the joint portions joined to contacts constituting at least two contact arrays adjacent to each other of the plurality of contact arrays extend in a same elongation direction, and wherein contacts constituting each contact array of the at least two contact arrays are disposed in a position other than a position where those contacts completely coincide with contacts constituting another contact array of the at least two contact arrays in a direction perpendicular to the predetermined array direction.

* * * * *